US005643145A

United States Patent [19]

Lo et al.

[11] Patent Number: 5,643,145

[45] Date of Patent: Jul. 1, 1997

[54] EXERCISE BIKE

[76] Inventors: Chung-Yen Lo; Fu-Shun Chien, both of No. 1-2, Lane 975, Chun-Jih Road, Tao-Yuan City, Taiwan

[21] Appl. No.: 715,449

[22] Filed: Sep. 18, 1996

[51] Int. Cl.[6] ..... A63B 23/04

[52] U.S. Cl. ..... 482/57; 482/95

[58] Field of Search ..... 482/57, 63, 51, 482/95, 96, 148, 62

[56] References Cited

U.S. PATENT DOCUMENTS

| | | | |
|---|---|---|---|
| 3,134,378 | 5/1964 | Harwood | 482/62 |
| 4,586,706 | 5/1986 | Chen | 482/62 |
| 4,660,826 | 4/1987 | Lee | 482/57 |
| 5,145,477 | 9/1992 | Han | 482/57 |
| 5,549,527 | 8/1996 | Yu | 482/95 |

*Primary Examiner*—Stephen R. Crow
*Attorney, Agent, or Firm*—Morton J. Rosenberg; David I. Klein

[57] ABSTRACT

The exercise bike includes a main frame, a handlebar, a driving wheel, a rotary wheel, a seat and a housing. The rotary wheel has a circular driving element eccentrically disposed at one side thereof. The driving element is provided with a driving arm and is secured in place by a positioning element. The driving arm has one end provided with a pivot hole. The seat has an elevating rod disposed below, which is mounted to the rear of the main frame by means of a tube such that the elevating rod may displace within the tube. Below the elevating rod are provided a spring and a stop rod for connecting with the pivot hole of the driving arm via a pivot element. The exercise bike utilizes the user's weight to act as an exercising load to provide resistance and enables the user to rise and fall rhythmically with the rotation of the bike.

5 Claims, 8 Drawing Sheets

EXERCISE BIKE

BACKGROUND OF THE INVENTION (a) Field of the Invention

The present invention relates generally to an exercise bike, and more particularly to an exercise bike in which the user's weight is utilized as a load to provide a damping force or resistance and the user's body may move up and down rhythmically with the movement of the exercise bike, achieving the object of exercising the entire body.

(b) Description of the Prior Art

There are numerous kinds of exercise bikes available in the marketplace. The main structure of these conventional exercise bikes is shown in FIG. 1. Referring to FIG. 1, a conventional exercise bike essentially comprises a frame 11, a handlebar 12 mounted at a front end of the frame 11, a meter panel 13, a seat 14 mounted at a rear end of the frame 11, and a pair of pedals 15. After these components are assembled, a housing (not shown) is provided to conceal the frame 11 to give an integral and nice look to the whole bike. Exercise bikes do provide a convenient means of exercising to those who are too busy to find time to ride a bicycle. Besides, these exercise bikes may be mounted indoors to provide exercise opportunities at any time. However, there are the following drawbacks with the conventional exercise bikes:

1. As the seat 14 is supported by a seat post 16 at its bottom side, which is locked inside a stem 110 of the frame 11 by means of a screw bolt 17 capable of adjusting the height of the seat post 16, after a selected height is set, the screw bolt 17 is passed through an adjusting hole 161 of the seat post 16 to fixedly secure the seat 14. Therefore, when the user pedals the bike, his/her upper trunk will not move up and down as in real cycling, so that the user may easily feel tired after some time. Besides, since only the feet are exercised, the overall exercising effect is limited.

2. In order to provide a damping force to enhance the exercising effect, the conventional exercise bike 1 is provided with a driving wheel 18 driven by the pedals 15, and a transmission element 181 is further provided to drive a load means 19 located at a suitable position inside the frame 11 so as to increase the damping force or resistance in exercising. However, the load means 19 has to be adjusted according to the needs of the user. If resistance is achieved by means of friction, the load means will wear fast. On the other hand, if electronic type magnetic control is utilized to increase resistance, the cost will be high. Besides, the exercise bike 1 will have to be connected to a power source, which is inconvenient to the user.

SUMMARY OF THE INVENTION

Accordingly, a primary object of the present invention is to provide an exercise bike in which a user seated on the bike may move up and down with the pedalling action as in actual cycling, achieving an improved overall exercising effect and eliminating the drawbacks with the prior art.

Another object of the present invention is to provide an exercise bike in which the user's weight is utilized as a load to provide a damping force or resistance in exercising which increase proportionally with the weight of the user so as to match the needs of different users and achieve optimum exercising amounts.

Still another object of the present invention is to provide an exercise bike which, aside from using the user's weight as a load to provide resistance in exercising, may further be provided with other load means to achieve an all dimensional adjustment of exercising amounts.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
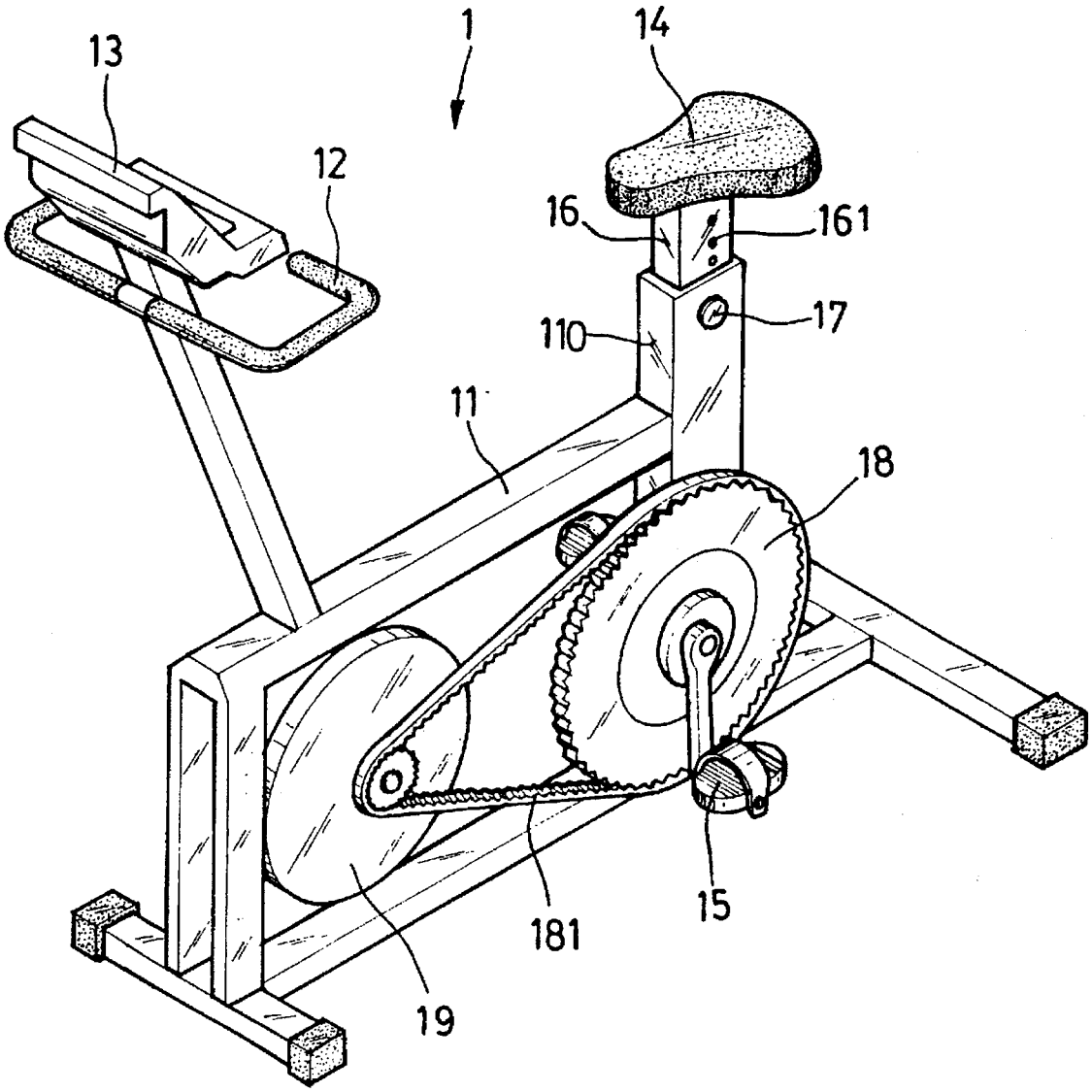
FIG. 1 is a schematic view of a conventional exercise bike.
Figure 2:
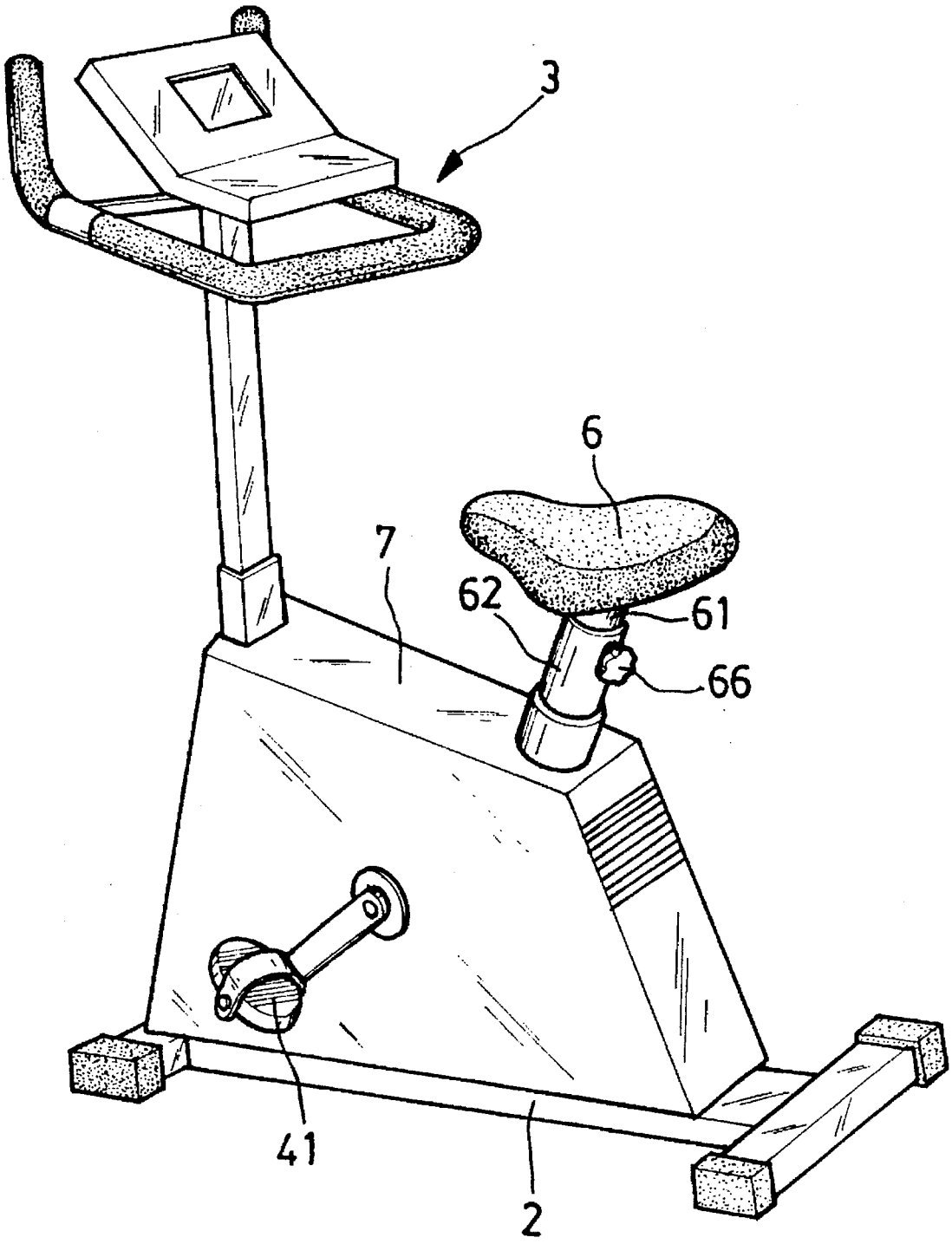
FIG. 2 is a schematic outer view of the present invention.
Figure 3:
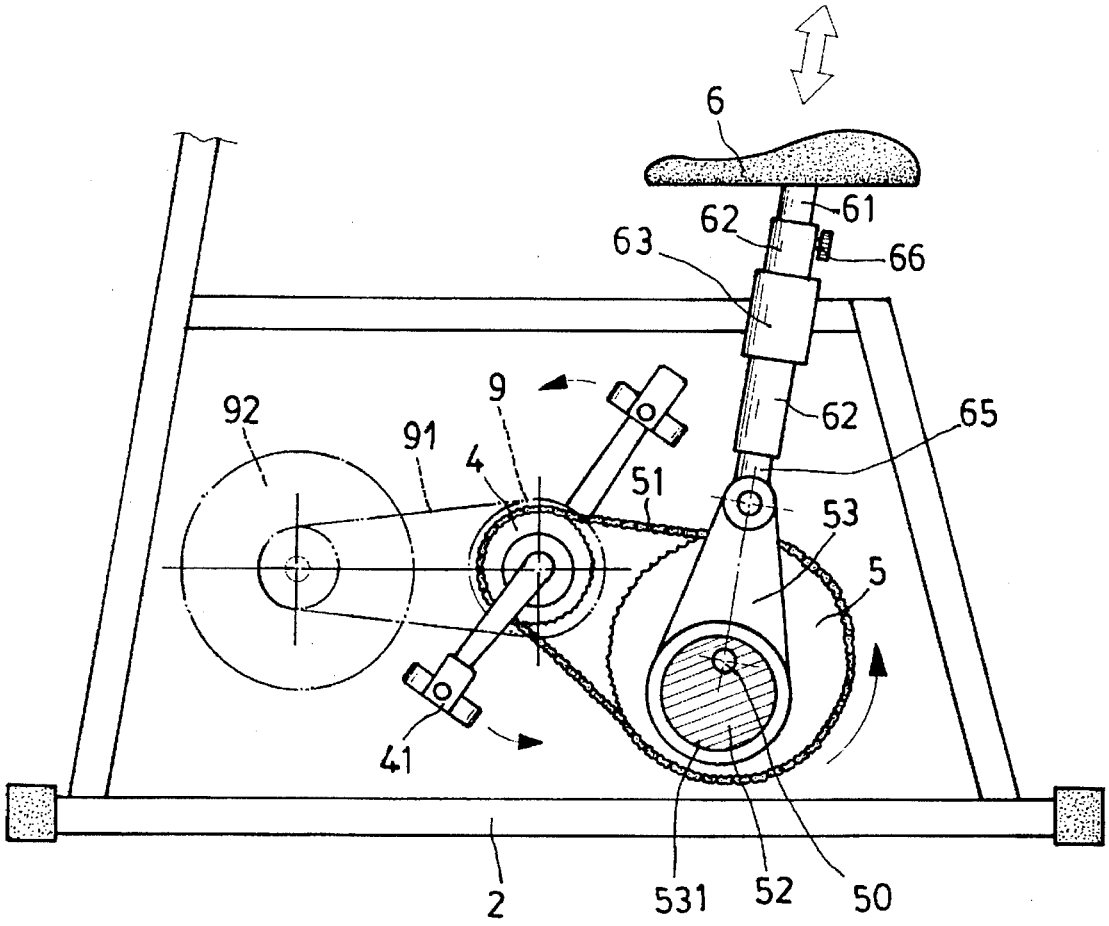
FIG. 3 is a schematic view illustrating the transmission mechanism of the present invention.
Figure 4:
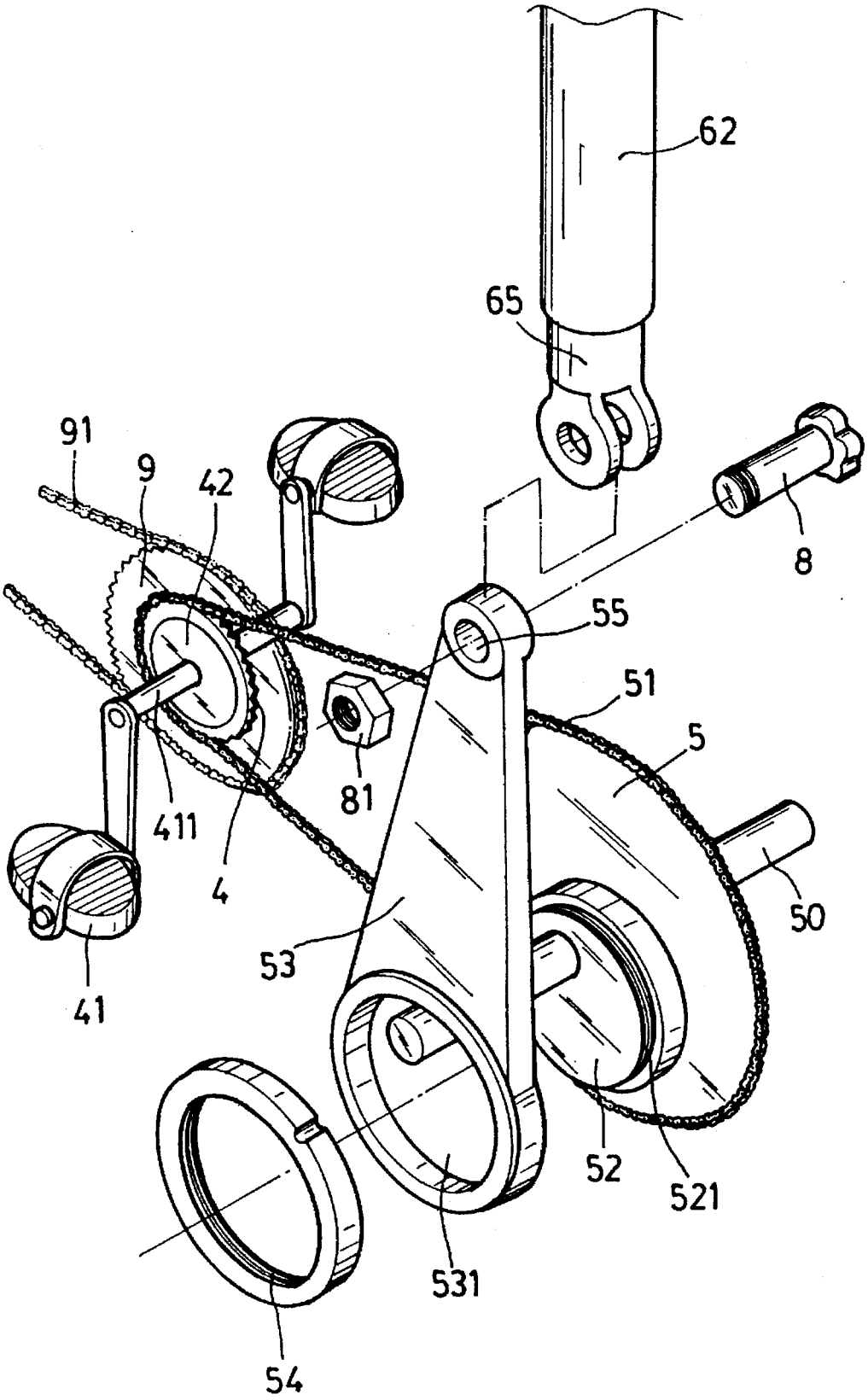
FIG. 4 is an elevational exploded view of the transmission mechanism of the present invention.

With reference to the drawings, the exercise bike according to the present invention essentially comprises: a main frame 2 for supporting components of the exercise bike; a handlebar 3 mounted at an upper front end of the main frame 2 and provided with a meter panel 31; a driving wheel 4 mounted at a middle section of the main frame 2 at a suitable position and having both sides thereof respectively provided with a pedal 41; a rotary wheel 5 mounted at a rear section of the main frame 2 at a suitable position and supported by a central shaft 50 positioned on the main frame 2, the rotary wheel 5 being connected to the driving wheel 4 via a transmission element 51; a seat 6 having a seat post 61 extending downwardly therefrom, the seat post 61 being fitted into an elevating rod 62; and a housing 7 for concealing those components which may easily hurt the user and giving an integral appearance to the exercise bike. The present invention is characterized in that the rotary wheel 5 has a circular driving element 52 eccentrically disposed at one side thereof, the circular driving element being so configured as to just fit into a shaft hole 531 at a bottom end of a driving arm 53, which is locked to an outer side 521 of the driving element by use of a positioning element 54, a top end of the driving arm 53 being provided with a pivot hole 55; the elevating rod 62 at the lower side of the seat 6 is passed through a tube 63 secured to the main frame 2 and has a lower rim thereof provided with a spring 64 and a stop rod 65 pivotally connected to the pivot hole 55 of the driving arm 53 by a pivot element 8. According to the present invention, the user's weight may be utilized as a load to provide resistance in exercising and the user may move up and down naturally with the operation of the exercise bike.

The above-mentioned elevating rod 62 and stop rod 65 are preferably cylindrical structures. Hence the tube 63 is preferably cylindrical. Certainly, all of them may be configured to be tubes with quadrilateral cross-sections.

Figure 8:
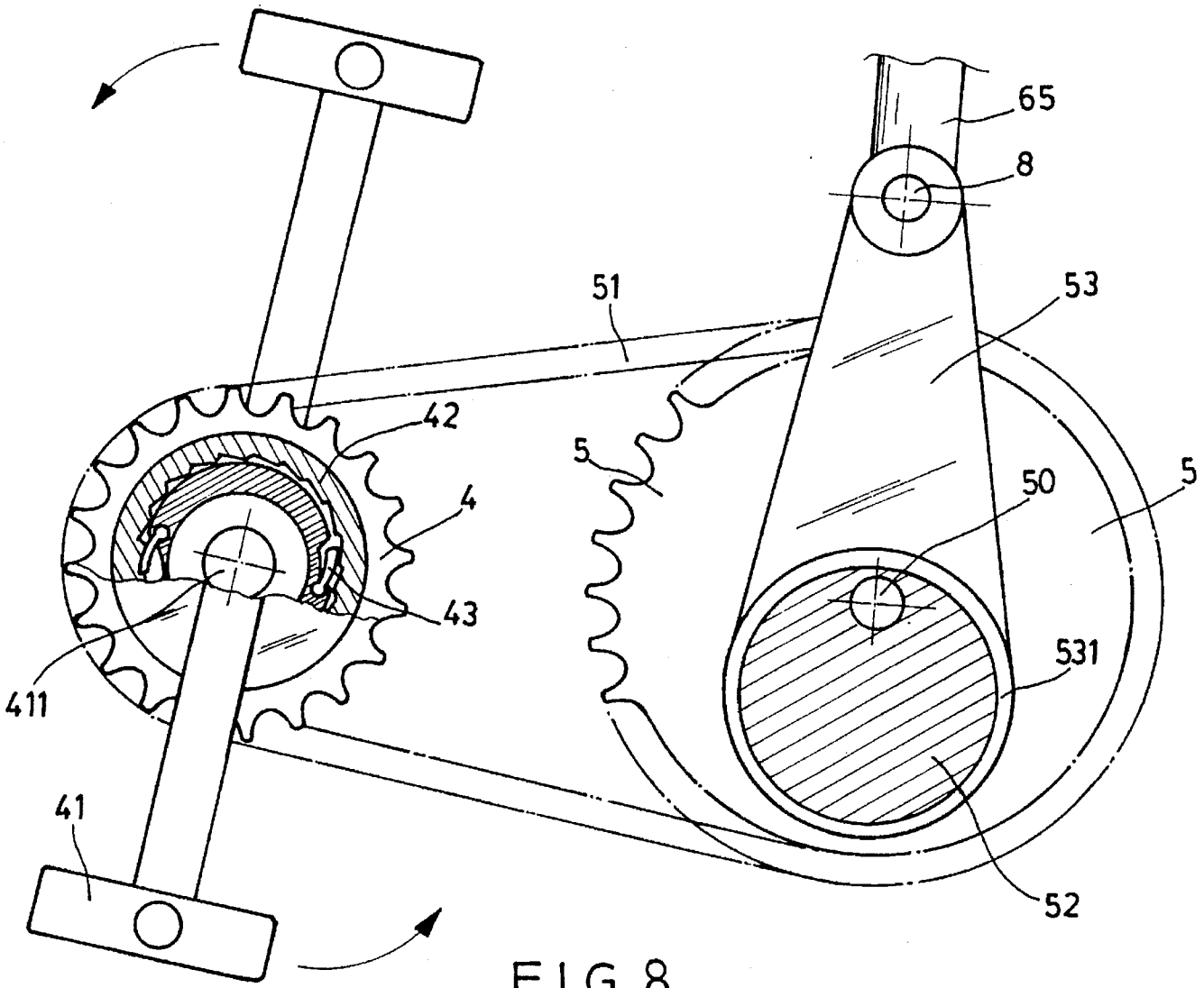
FIG. 8 is a schematic view illustrating the transmission mechanism during pedalling actions of the exercise bike of the present invention.

Furthermore, with reference to FIG. 8, the driving wheel 4 rotates in a unidirectional fashion. By means of the unidirectional urging actions of its internal ratchet 42 and stop elements 43, the driving wheel 4 may be driven by the pedals 41 unidirectionally only. As such a principle is similar to that used in ordinary bicycles, it is not discussed in detail herein. However, a unidirectional bearing may be used in place of the pedal shafts 411 of the pedals 41 to couple with the driving wheel 4 to achieve equivalent effects.

Figure 5:
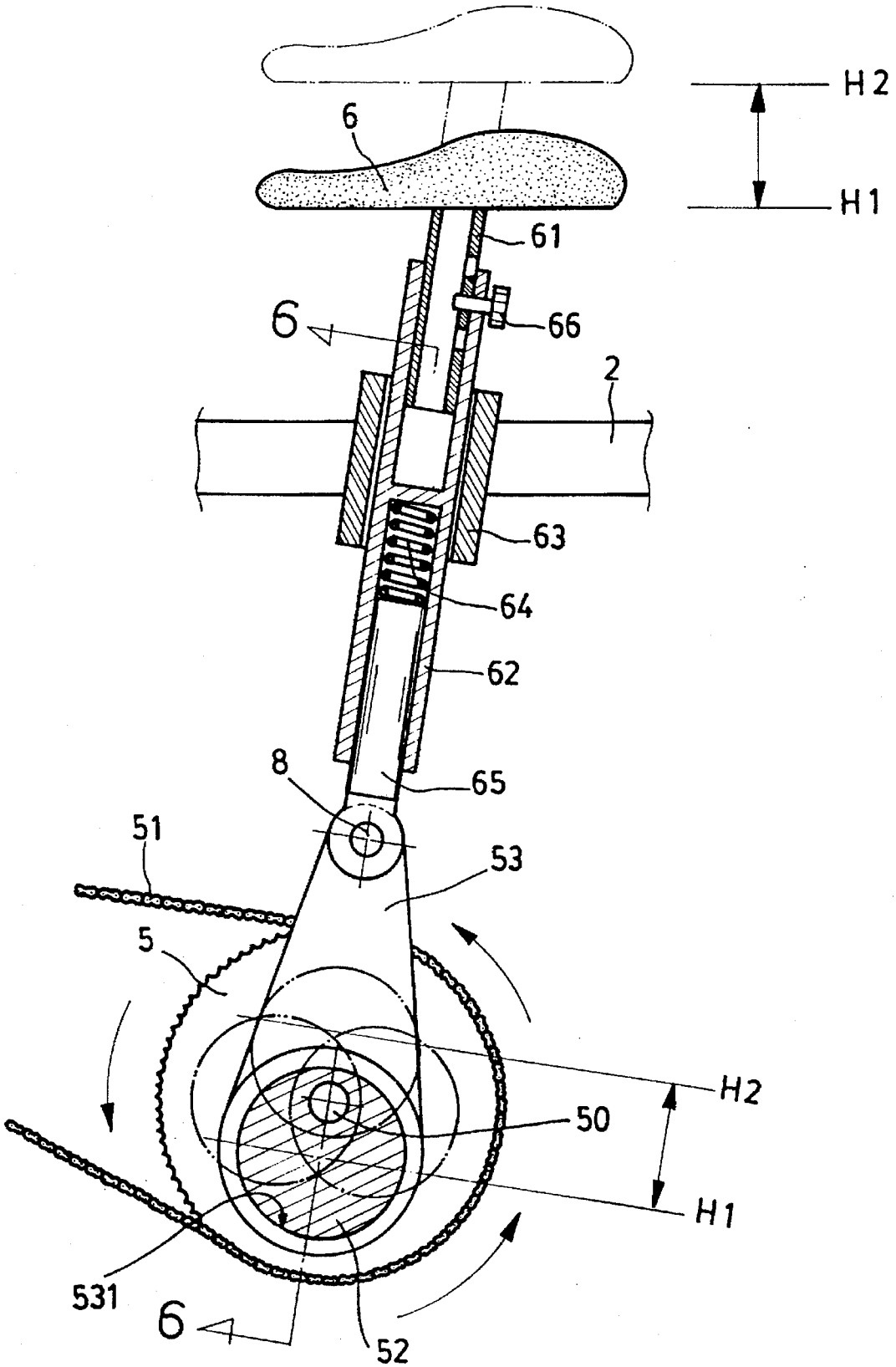
FIG. 5 is a schematic view of the elevation mechanism of the present invention.
Figure 6:
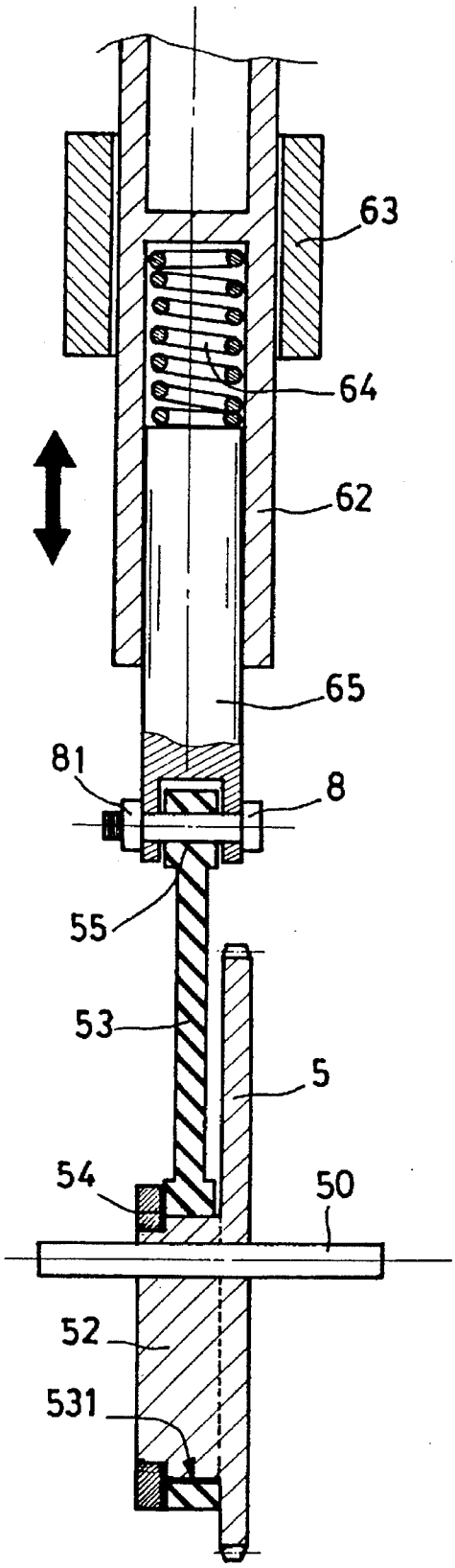
FIG. 6 is a sectional view of FIG. 5, taken along line 6—6.

In addition, with reference to FIG. 5, the relative height between the seat post 61 of the seat 6 and the elevating rod 62 may be adjusted by means of an adjusting element 66 so as to match the heights of different users.

The working principle and use of the exercise bike according to the present invention will be described hereinbelow with reference to the accompanying drawings.

Referring to FIGS. 3 to 6, when the user works the pedals 41, causing the driving wheel 4 to drive the rotary wheel 5 via the transmission element 51, the circular driving element 52 arranged in an eccentric mode at one side of the rotary wheel 5 will eccentrically rotate with the central shaft 50 as a fixed point, as illustrated in FIG. 5. The central position of a lower starting point of the circular driving element 52 is determined as H1. When the circular driving element rotates to an upper starting point, its central position is elevated to H2. In other words, after the circular driving element 52 has made a rotation with the rotary wheel 5, the driving arm 53 fitted thereon will rotate therewith as well, resulting in the changes from H1 to H2, and vice versa. At this point, the driving arm 53, via the stop rod 65 at the lower side of the elevating rod 62, pushes the elevating rod 62 so that the latter moves up and down within the tube 63, causing the user riding on the seat 6 to rise and fall from H1 to H2 and vice versa.

Figure 7:
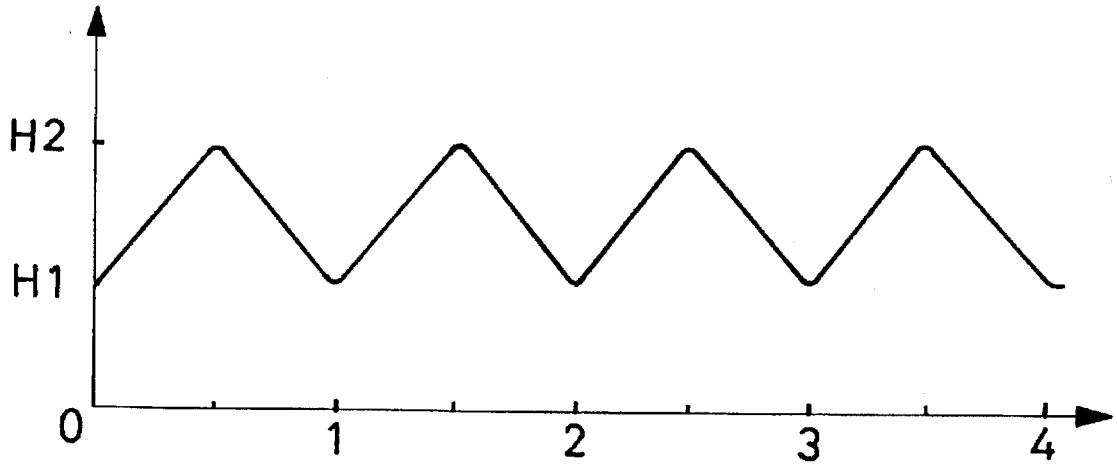
FIG. 7 is a a graph showing the relationship between the number of rotations of a rotary wheel and the extent of up and down movements.

With reference to FIG. 7, if the number of rotations of the rotary wheel 5 is taken as the horizontal axis and the extent of the up and down movements of the seat is taken as the longitudinal axis, it can be seen from the graph that the seat 6 moves rhythmically up and down in proportion to each rotation of the rotary wheel 5. Therefore, the user may rise and fall rhythmically as in actual cycling. Besides, such rhythmic movement may help regulating the user's breathing and heartbeat, enabling the user to totally relax to achieve an overall exercising effect.

Although the principle of eccentric rotation used in the present invention to achieve rhythmic up and down movements has been known, the technical means used in the present invention to solve the problems with the prior art is novel. With reference to FIG. 5, the area of the circular driving element 52 includes the central shaft 50 of the rotary wheel. In this way, when the shaft hole 531 at the bottom end of the driving arm 53 is fitted onto the outer periphery of the circular driving element 52, it may rotate smoothly without touching the central shaft 50. Besides, the diameter of the circular driving element 52 is preferably not too small so as to prevent forming dead spots which may obstruct smooth rotation. Furthermore, the driving arm 53 is not directly connected to the elevating rod 62 but is pivotally connected to the stop rod 65. The advantages of such an arrangement are: Firstly, it does not require much force to work the pedals 41; the spring 64 above the stop rod 65 may reduce parts of the pushing force so that the driving arm 53 may be pushed with relative ease. Secondly, when the elevating rod 62 is moving up and down, a buffering effect may be achieved to make the user feel more comfortable. The design of the elevating rod 62 thus accomplishes the dual effects of smooth rotation and comfortable riding.

The design of the unidirectional rotation of the driving wheel will now be described with reference to FIG. 8. When the pedals 41 are driven forwardly, the pedal shafts 411 utilize the stop elements 43 to urge against the ratchet 42, so that the driving wheel 4 rotates in a counter-clockwise direction, and the transmission element 51 hence drives the rotary wheel to further cause the driving arm 53 to perform up and down rotations. And when the pedals 41 are released, due to the action of inertia, the rotary wheel 5 will continue to rotate. At this point, the transmission element 51, on the contrary, is subjected to the driving force of the rotary wheel 5, forcing the driving wheel 4 to rotate. However, the ratchet 42, performing counter-clockwise rotation at the point, will slip past the stop element 43 in a state of idle rotation. Therefore, the pedal shafts 411 will remain still to prevent the pedals 41 from hitting the user's feet, ensuring safety of the user.

The above-mentioned driving wheel 4 and rotary wheel 5 are preferably provided with teeth, while the transmission element 51 is preferably a chain. Certainly, the transmission element 51 may also be formed by a belt, or the driving wheel 4 and the rotary wheel 5 may be configured to be belts matching the belt type transmission element. As this is merely substitution of equivalent components, it will not be further described herein.

Referring back to FIGS. 3 and 4, the present invention not only enables the user to move up and down rhythmically when riding the exercise bike, it also utilizes the user's weight as a load to provide resistance in exercising. Obviously, for those who need greater amount of exercising, the present invention may further include a rotary wheel 9 connected to the pedal shafts 411, and a transmission element 9 linked up with a load means 92 located inside the main frame 2 at a suitable position. In this way, the present invention may provide a greater damping force or resistance to meet the needs of pros or special persons.

For clarity's sake, the advantages of the present invention are further explained below:

1. The arrangement of the structural components enable smooth rotation with good performance. The exercise bike of the invention does not require electric power in order to perform up and down rhythmic movements.

2. As the exercise load mainly comes from the user's weight, the amount of exercising required by heavier users is relatively high and that required by slimmer users is relatively low. The present invention may therefore provide suitable amounts of exercising to different users. If necessary, other load means may be added to meet the needs of particular users.

3. In the preferred embodiments illustrated herein, the driving wheel used to rotary wheel 5 is smaller in size than the latter. Such a design may slow down the up and down movements. Besides, it may enhance the torsional force, providing smooth pedalling and smooth elevation. The present invention is therefore suitable for users of all ages.

Although the present invention has been illustrated and described with reference to the preferred embodiment thereof, it should be understood that it is in no way limited to the details of such embodiment but is capable of numerous modifications within the scope of the appended claims.

What is claimed is:

1. An exercise bike, comprising:

a main frame;

a handlebar mounted at an upper front end of said main frame and provided with a meter panel;

a driving wheel mounted at a middle section of said main frame at a suitable position and having both sides thereof respectively provided with a pedal;

a rotary wheel mounted at a rear section of said main frame at a suitable position and supported by a central shaft positioned on said main frame, said rotary wheel being connected to said driving wheel via a transmission element;

a seat having a seat post extending downwardly therefrom, said seat post being fitted into an elevating rod; and a housing for concealing those components which may easily hurt the user and giving an integral appearance to the exercise bike, wherein said rotary wheel has a circular driving element eccentrically disposed at one side thereof, said circular driving element being so configured as to just fit into a shaft hole at a bottom end of a driving arm, which is locked to an outer side of said driving element by use of a positioning element, a top end of said driving arm being provided with a pivot hole; said elevating rod at the lower side of said seat is passed through a tube secured to said main frame and has a lower rim thereof provided with a spring and a stop rod pivotally connected to said pivot hole of said driving arm by a pivot element; whereby the user's weight may be utilized as a load in exercising to provide resistance and the user may move up and down naturally and rhythmically with the operation of the exercise bike.

2. The exercise bike as claimed in claim 1, wherein said elevating rod, said stop rod and said tube preferably have circular or quadrilateral cross-sections.

3. The exercise bike as claimed in claim 1, wherein said pedals may drive said driving wheel in a unidirectional direction only.

4. The exercise bike as claimed in claim 1, wherein the relative height between said seat post and said elevating rod may be adjusted by an adjusting element.

5. The exercise bike as claimed in claim 1, wherein said pedal shafts may be coupled with a second rotary wheel and a second transmission element for connecting with an additional load means.

* * * * *